United States Patent [19]

Staat

[11] Patent Number: 4,577,481

[45] Date of Patent: Mar. 25, 1986

[54] PROCESS FOR PRODUCTION OF SEAMLESS TUBE AND APPARATUS FOR PROCESSING SEAMLESS TUBE

[75] Inventor: Karlhans Staat, Homberg, Fed. Rep. of Germany

[73] Assignee: Kocks Technik GmbH & Co., Hilden, Fed. Rep. of Germany

[21] Appl. No.: 588,244

[22] Filed: Mar. 12, 1984

[30] Foreign Application Priority Data

Mar. 18, 1983 [DE] Fed. Rep. of Germany ..... 3309797

[51] Int. Cl.[4] ..... B21B 19/04

[52] U.S. Cl. ..... 72/68; 72/97; 72/208; 72/368

[58] Field of Search ..... 72/96, 97, 68, 368, 72/370, 208, 206

[56] References Cited

U.S. PATENT DOCUMENTS 2,803,154 8/1957 McLay ..... 72/97

FOREIGN PATENT DOCUMENTS 1092717 11/1967 United Kingdom ..... 72/208
2086283 5/1982 United Kingdom ..... 72/97
590024 1/1978 U.S.S.R. ..... 72/97

*Primary Examiner*—Lowell A. Larson
*Attorney, Agent, or Firm*—Buell, Ziesenheim, Beck & Alstadt

[57] ABSTRACT

A process and apparatus for the production of seamless tubing incorporating a push bench is provided in which ingots are pierced in the longitudinal direction by diagonal rolls over the stopper rods of a piercing mill to provide pierced ingots having one end with a wall thickening which protrudes outwardly or inwardly, then the wall thickening ends reshaped to provide a partially closed end and finally the pierced ingots are forced through the roll passes of a push bench by mandrel rods engaging the partially closed end so that the ingots are formed into a tube bloom.

7 Claims, 4 Drawing Figures

PROCESS FOR PRODUCTION OF SEAMLESS TUBE AND APPARATUS FOR PROCESSING SEAMLESS TUBE

This invention relates to a process for producing seamless tube and an apparatus for processing seamless tube and more particularly to a process in which ingots are centrally pierced by diagonally rolling the ingots over a piercer rod and then pushed through the roll passes of a push bench by a mandrel rod bearing on an inwardly thickened portion of the punched ingot.

In a previously disclosed process of this type (DE-PS 30 31 940), after the piercing of the ingots on the piercing roll train, the front end section of each hollow ingot first leaving the latter is shaped by flanging such that the full-length longitudinal hole formed first on the piercing roll train is reduced in diameter at this front end section and thus partially closed. This partially closed front end section serves as a point of support for the end face of the mandrel rod during the subsequent push process.

The above familiar process has the shortcoming that a flanging press must be provided and the latter can operate only intermittently and this interrupts the otherwise continuous operation. In the case of flanging it is also necessary that the wall thickness in the swaging zone be sufficient so that during ramming the required impact force can be transferred from the end face of the mandrel rod to the hollow ingot. However, such a massive swaging with a thick wall requires considerable time and thus reduces the output of an arrangement operating by this process. It is possible to shorten the time required for flanging if the flanging process is carried out less intensively, i.e., if the end section of the hollow ingot is less stable during flanging. However, there is then the danger that this weaker swaging would not withstand the pressure of the mandrel rod during the ramming process, but would be pushed through. Furthermore, material damage can occur in the hollow ingot in the region of the flanged end section during flanging and the material can also cool during flanging and thus harden to such an extent that damage can result to the push bench, especially to its rolls and roll stands, during the subsequent impact process. In addition, the front end section of the hollow ingot is flanged during the familiar process such that it and the rear end section, also frayed, subsequently have to be removed and scrapped, which considerably reduces the output of an arrangement operating in this manner. If the rear end section were swaged, it would have to be cropped beforehand due to its frayed condition and again after swaging and pushing because both ends of the longitudinal hole have to be open prior to further processing. In the familiar process, therefore, it is always necessary to remove and scrap a portion of the hollow ingot or tube bloom twice, which means a substantial material loss.

The present invention offers an improved process of the above type, in which the flanging by means of a flanging press can be eliminated and thus a greater efficiency with improved economy can be attained.

This problem is solved in accordance with the invention in that a short wall thickening that projects radially outward and/or inward is rolled on at the rear end sections of the ingots during diagonal rolling, which, if it projects outward, is forced inward into the longitudinal hole during a subsequent shaping process and is used during the subsequent pushing as a point of support for the end face of the mandrel rod.

As a result, the short wall thickening that is required as a stable supplement for the mandrel rod end surface during diagonal rolling is obtained and no particular flanging arrangement is required for producing this wall thickening. During the diagonal rolling, which is still required, the wall thickening can be produced in a relatively simple manner by spreading the diagonal rolls of the piercing roll train rapidly in the radial direction by an amount corresponding to the wall thickening required shortly before the rear ingot end is reached, so that the wall thickening projecting radially outward and/or inward is formed. It is thus possible that the wall thickening during this process also acts inward into the longitudinal hole of the hollow ingot, because during diagonal rolling the extent of expansion of the longitudinal hole, by which the bore diameter becomes larger than the maximum diameter of the stopper rod, is a function of the rolled wall thickness of the hollow ingot. If this wall thickness is increased due to the radial shifting of the diagonal rolls outward, the expansion of the longitudinal hole is then reduced, so that a wall thickening inward into the longitudinal hole can also occur at the corresponding dimensions.

It is advantageous here that the above disadvantages associated with the flanging are avoided and especially that the rear end section is no longer frayed and consequently has to be cropped only once, namely, after pushing, which results in a substantial material saving, increases the yield, and improves the economy.

The wall thickening protruding outward is according to the invention to be completely forced inward into the longitudinal hole in order to serve later as a point of support for the end face of the mandrel rod. A flanging press or other supplementary arrangement is not required for this reshaping process; rather, this shaping process takes place according to the invention, together with another procedural step that is also required and by means of equipment that is already present. According to an advantageous feature of the invention, it is thus possible to shape the wall thickenings of the ingots that project outward after piercing rolling inward into the longitudinal hole during subsequent passage through a hollow-ingot or calibrating roll train. Such roll trains otherwise serve merely to relieve the load on the push bench and to feed hollow ingots with different dimension to it.

However, if such a hollow-ingot or calibrating roll train is not used, it is possible according to an additional feature of the invention for the outward-protruding wall thickenings of the ingots after the piercing rolling to be shaped inward into the longitudinal hole during subsequent passage through the stand or stands on the entrance side of the push bench, before the actual pushing process is carried out in the subsequent stands. For example, the first stand of the push bench has such a large pass opening here that it contacts essentially only the wall thickening that projects radially outward and presses it inward into the longitudinal hole of the hollow ingot. Only in the following passes of the push bench is the outside diameter and the wall thickness of the hollow ingot, as is conventional in the push bench process, reduced, in which case the mandrel rod through its end face and the wall thickening of the hollow ingot drives the latter.

It is also possible to force the wall thickenings of the ingots that project outward into the longitudinal hole with a clamping device of the push bench that fixes the ingots during insertion of the mandrel after the piercing rolling, but prior to insertion into the stand or stands on the entrance side of the push bench. An additional step is thus dispensed with, because the fixation of the hollow ingot during insertion of the mandrel rod is at the same time an inward shaping into the longitudinal hole of the outward-protruding wall thickening. In this case, the wall thickening also formed the required stable point of support for the mandrel rod so that a normal cross sectional reduction can be used in all the stands of the push bench and a push or impact process can be carried out in the conventional manner.

The invention also concerns an arrangement for conducting the process according to the invention with a piercing roll train having diagonal rolls, a reshaping mechanism for the wall thickenings, and a push bench. DE-PS 30 21 940 already shows such an arrangement, but one in which a flanging press is utilized as the reshaping mechanism. In contrast, the arrangement according to the invention is characterized in that the diagonal rolls of the piercing roll train are rapidly adjustable to a larger pass opening shortly before rolling out the emerging ingot end. With a piercing roll train designed in this manner, the desired wall thickening can be attained without the use of an additional arrangement, such as a flanging press, for example.

According to another feature of the invention, a hollow-ingot or calibrating roll train can be located beyond the piercing roll train and in front of the push bench as the deformation mechanism for the wall thickenings, which has the task of pressing the outward-projecting wall thickenings into the longitudinal holes of the hollow ingots. In another embodiment of the invention the first stand or stands of the push bench serve as the deformation mechanism for the wall thickenings; their passes are formed of driven rolls that have an increased pass opening, which corresponds to the outside diameter of the ingots, increased as a result of the wall thickening. In general, the stands of push benches are not motor-driven, but this is recommended in the present case, at least in the first stand, due to the deformation of the wall thickenings. One can generally manage with a drive for the first stand of the push bench. Only in extreme cases is it recommended to provide the second stand of the push bench with driven rolls also. The diameter reduction in these first stands of the push bench is expediently kept small so that only the outward projecting wall thickening is deformed inward first. The pass opening of the first stand or stands should be slightly larger than the outside diameter of the hollow ingot behind the advancing end section with the wall thickening. This has the advantage that during the subsequent pushing process the hollow ingot is incapable of driving the first stand or stands of the push bench, such that the drive of these first stands is advantageously prevented from working against the mandrel rod drive.

In another embodiment of the invention a clamping fixture that fixes the pierced ingot during insertion of the mandrel rod can be provided as the deformation mechanism for the wall thickenings. A clamping fixture is also present in the familiar push benches in order to be able to insert the mandrel rod into the hollow ingot prior to beginning the actual pushing process. According to the invention, this clamping fixture is designed without appreciable additional cost as the deformation arrangement for the wall thickenings and is so used, so that prior to introducing the hollow ingot into the first stand, the inward deformed wall thickenings form a flawless and stable point of contact for the end face of the mandrel rod.

In the foregoing statement of this invention I have set out certain objects, purposes and advantages of this invention. Other objects, purposes and advantages of the invention will be apparent from a consideration of the following description and the accompanying drawings in which.

Figure 1:
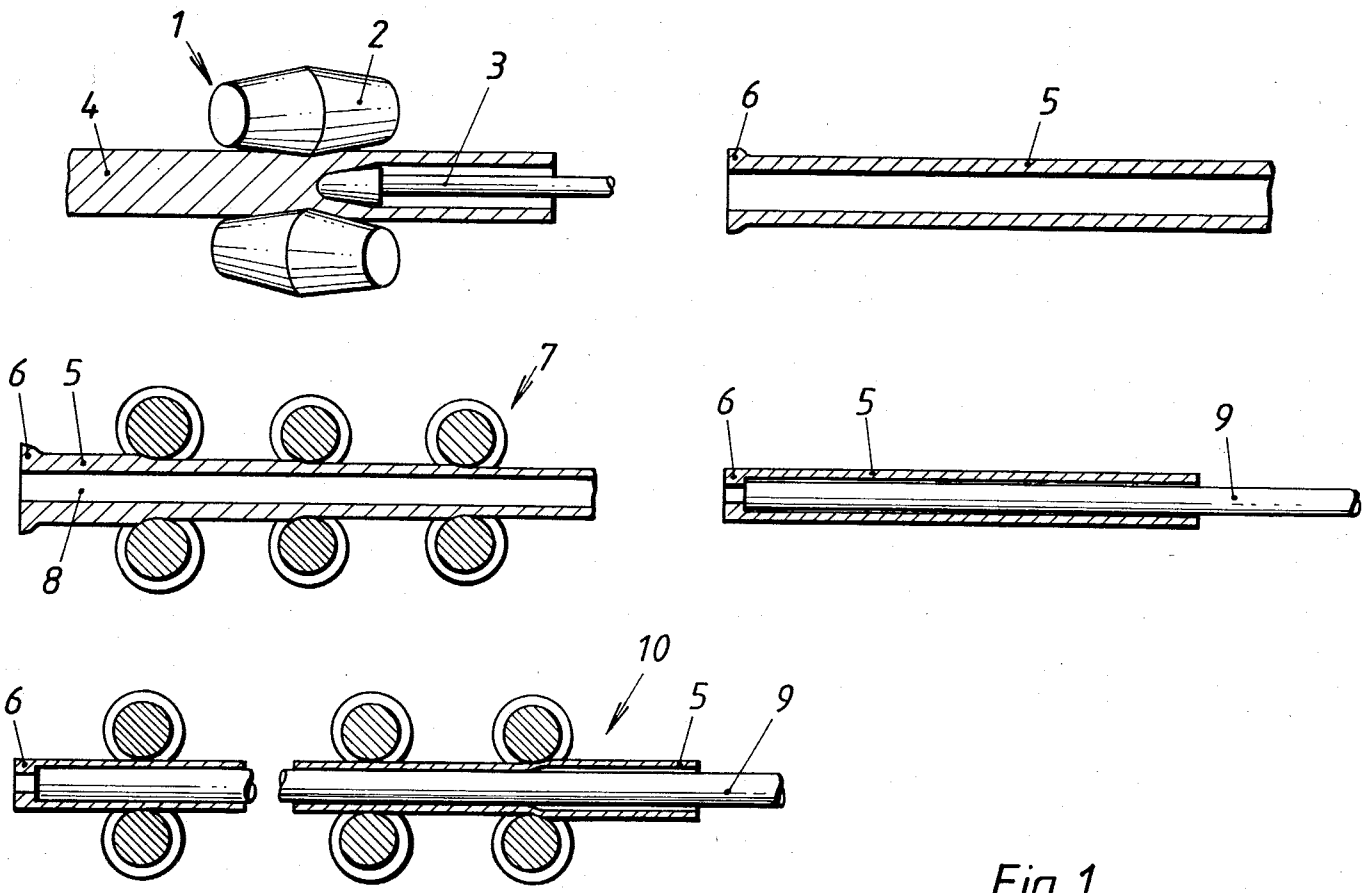
FIG. 1 shows a schematic representation of the procedure according to the invention.

Referring to the drawings I have illustrated a piercing roll train which is designated by 1 in FIG. 1; it is symbolized by the diagonal rolls 2 and a stopper rod 3. An ingot 4, which passes through the piercing roll train 1 from left to right, is thus converted in the familiar manner into a hollow ingot 5, which is shown in longitudinal section to the right of the piercing roll train 1. The wall thickenings 6 are clearly detectable on the rear end section of the hollow ingot 5 (at the left); they were produced by moving the rolls 2 of the piercing roll train 1 out in the radial direction by a given degree as the rear end section of the ingot 4 or the hollow ingot 5 was rolled. When the hollow ingot 5 has left the piercing roll train 1, the rolls 2 are again returned to their original position, as shown in FIG. 1, so that the next ingot 4 can be rolled in the same manner.

The hollow ingot 5 is then rolled in a hollow-ingot or calibrating roll train 7 that has several roll passes. In this hollow-ingot or calibrating roll train 7 the hollow ingot 5 is conventionally reduced in its outer diameter and it is thus possible to produce hollow ingots 5 of varying size from one size of the ingot 4, in order to be able to realize a greater rolling program. This familiar hollow-ingot or calibrating roll train 7 is also used in the process according to the invention to deform the wall thickenings 6 of the hollow ingots 5 inward into the longitudinal hole designated by 8. Because the wall thickenings 6 are located at the rear end section of the hollow ingots 5, there are no gripping problems when the hollow ingots 5 enter into the hollow-ingot or calibrating roll train 7. The result is shown in FIG. 1 to the right of it. A ready-rolled hollow ingot 5, in which the wall thickening 6 has been deformed inward, is shown there.

A mandrel rod 9 is then inserted into the hollow ingot 5 rolled in this manner; this generally occurs on a push bench 10, which is represented symbolically in FIG. 1 by a few roll passes. The mandrel rod 9 presses the hollow ingot 5 through these roll passes, in which case its end face is supported on the wall thickenings 6, which project inward into the longitudinal hole 8. After pushing, the mandrel rod 9 is withdrawn from the tube bloom, as is conventional, and the rear end section with the wall thickening 6 is removed. Further processing then takes place (not shown), e.g., in a stretch-reduction roll mill.

Figure 2:
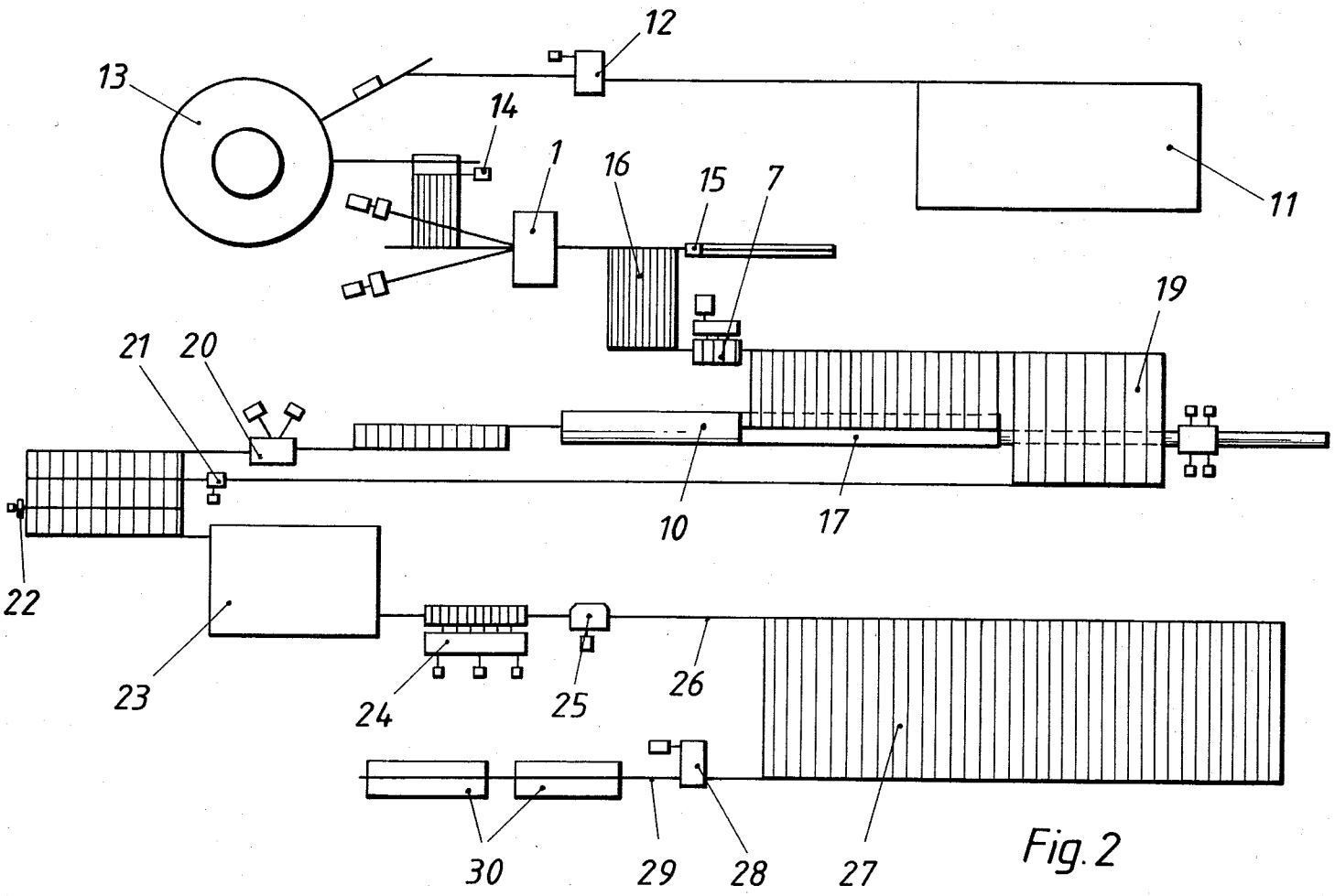
FIG. 2 shows a top view of an apparatus for carrying out the process according to FIG. 1.

In FIG. 2 a billet storage area is designated by 11. From it the billets are fed to an ingot saw 12, where they are cut into ingots 4 of the desired length. They then pass into an oven 13, in which they acquire their rolling temperature. An ingot centering arrangement 14 is located at the removal point of the oven 13; it marks the middle of the ingot cross section in order to assure a flawless entrance of the ingots 4 into the subsequent piercing roll train 1, in particular, a centered rolling of the longitudinal hole 8. The tip of the stopper rod 3 (see FIG. 1) is centered by the mark of the ingot centering arrangement 14 and the rolling process from ingot 4 to hollow ingot 5, already described, takes place. The stopper rod 3 is then withdrawn, together with its support 15. The hollow ingot thus freed of the stopper rod moves over a transverse transport arrangement 16 to the hollow-ingot or calibrating roll train 7. There, as already described, the hollow ingot 5 is reduced in diameter and the wall thickening 6 is pressed into the longitudinal hole 8. The hollow ingot 5 thus reaches a table 17 of a push bench 10, where a mandrel rod 9 is inserted into the hollow ingot 5 before the actual pushing process in the push bench 10 takes place. A mandrel rod circulation 19 is assigned to the push bench 10, via which the mandrel rods 9 are prepared after they are loosened from the tube bloom by a releasing roll mill 20 beyond the push bench 10 and are withdrawn from the tube bloom with the aid of a mandrel rod extractor 21.

A cropping saw 22 then separates the wall thickenings 6 from the tube blooms before they go into a reheating oven 23, from which they, having been again brought to rolling temperature, are further processed in a stretch-reduction roll mill 24 into finished tube. A flying saw 25 divides the finished tube into finished tube sections before they pass over a discharge roller table 26 to a cooling bed 27 and are cooled there. Further subdividing and cropping are possible with the aid of a cold saw 28, before the finished tubes run over a discharge roller table 29 to a collecting trough 30 for hauling away.

Figure 3:
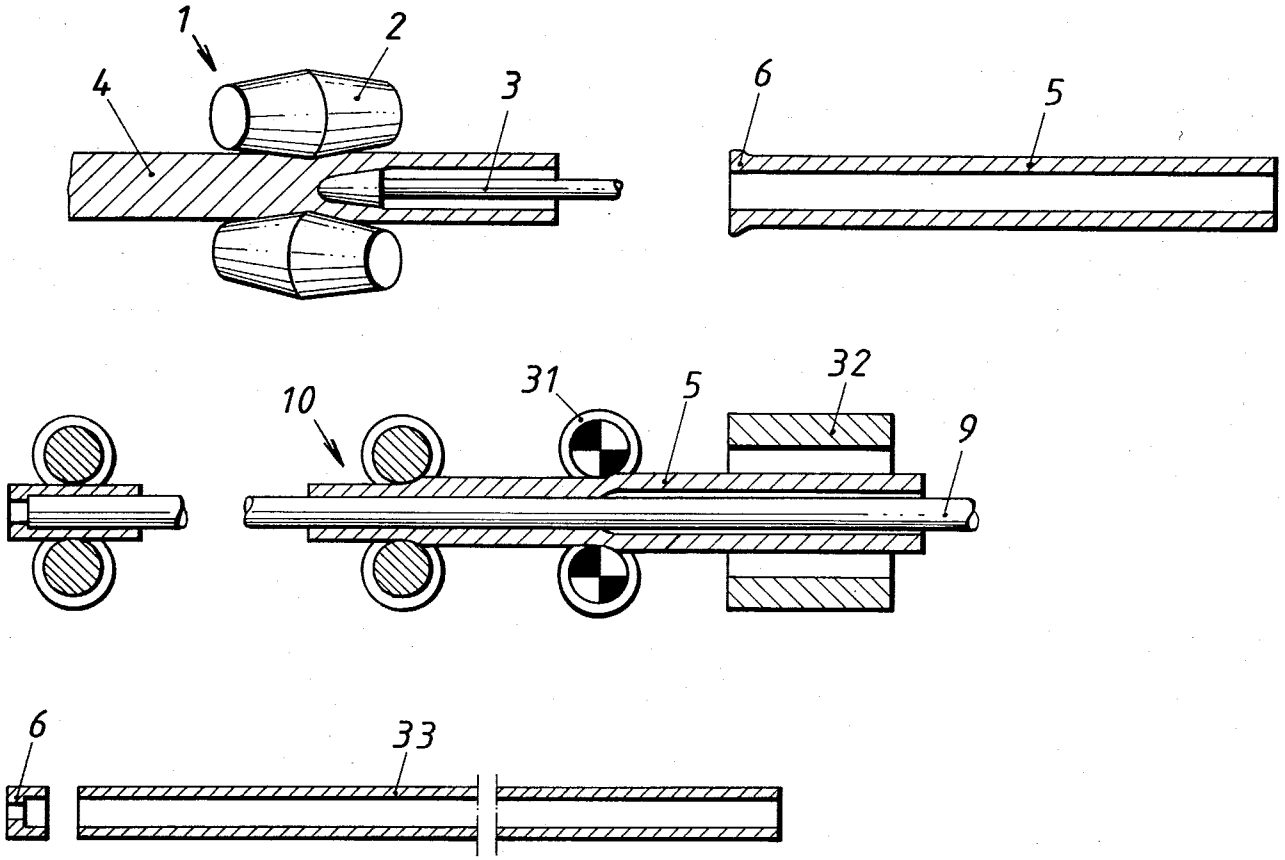
FIG. 3 shows a schematic representation of a second mode of conducting the process according to the invention.

The process shown in FIG. 3 essentially matches that of FIG. 1; consequently, the same reference numbers are used. The essential difference resides in the fact that the rolling in the hollow-ingot or calibrating roll train 7 drops out and that the hollow ingot is fed directly to the push bench 10 beyond the piercing roll mill 1. At this point in time, the wall thickening 6 on the hollow ingot 5 is still directed outward, such that the mandrel rod 9 has no point of support for its front end face. There are then two possibilities, both of which are shown in FIG. 3. First, the first stand 31 on the entrance side of the push bench 10 or its rolls are motor-driven as in a roll train. The pass opening of this first stand 31 is large enough so that the wall thickening 6 can be gripped and deformed inward, without any clamping or gripping problems. The rolls of this first stand 31 then take over the function of the hollow-ingot or calibrating roll train 7 according to FIGS. 1 and 2 and press the wall thickening 6 into the longitudinal hole 8. The drive of the push bench 10 through the mandrel rod 9 is then controlled so that an appreciable feeding power sets in only when the advancing end section of the hollow ingot 5 has already passed through the rolls of the first stand 31. Then the end face of the mandrel rod 9 encounters resistance at the wall thickening 6 which then projects inward and the pushing process can be carried out in the conventional manner.

The second possibility consists in the fact that the wall thickening 6 is pressed into the longtiudinal hole 8 with the aid of a pinching or clamping device 32 prior to the entrance of the hollow ingot 5 into the first stand 31 of the push bench 10, and that only then is the mandrel rod 9 inserted into the hollow ingots 5. A clamping device 32 is also present in familiar push bench arrangements, but it serves merely to hold the hollow ingot 5 fast during insertion of the mandrel rod 9. According to the invention, this clamping device 32 is used to deform the wall thickening 6 inward. Then the rolls of the first stand 31 do not need to be driven. In addition, the above two possibilities can also be combined.

The end section with the wall thickening 6 is cut off only once according to the invention, that is, after the tube bloom 33 thus produced has been pushed through. The front end section during piercing rolling remains uncropped.

Figure 4:
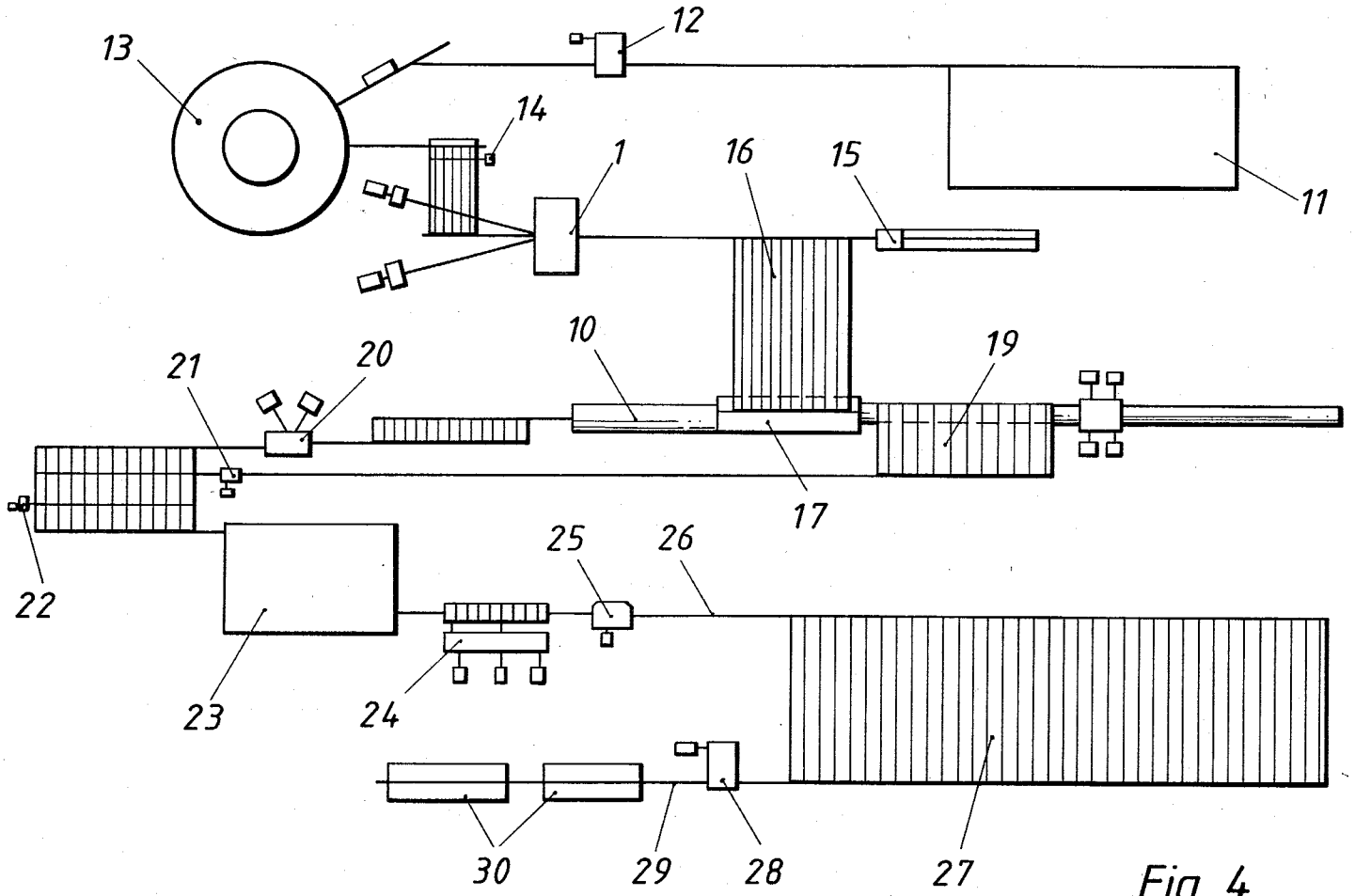
FIG. 4 shows a top view of an apparatus for carrying out the process according to FIG. 3.

FIG. 4 differs from FIG. 2 essentially only in that the hollow-ingot or calibrating roll train 7 is absent and the transverse transport arrangement 16 leads directly to the feed board 17 of the push bench 10.

In the foregoing specification I have set out certain preferred practices and embodiments of this invention, however, it will be understood that this invention may be otherwise embodied within the scope of the following claims.

I claim:

1. A process for the production of seamless tube comprising the steps of (a) centrally piercing an ingot to form a generally axial hole through its entire length by diagonally rolling said ingot over a piercing mandrel on the end of a mandrel rod;

(b) forming a short wall thickening at one end of said ingot extending one of radially outwardly, radially inwardly and both radially outwardly and inwardly around said axial hole at the end of the piercing operation.

(c) Rolling said short wall thickening at said one end of said ingot without internal support to reduce the diameter of the axial hole at said one end to form a thickened support member of generally uniform thickness for the end face of a mandrel;

(d) inserting a push bench mandrel into said axial hole to abut the previously formed support member;

(e) rolling said ingot in a push bench to form a seamless tube having a thickened support member at one end; and (f) removing said support member to form a completed seamless tube.

2. Process according to claim 1, characterized in that the wall thickenings of the ingots that protrude outward are pushed inward into the longitudinal hole after the piercing rolling during subsequent passage through one of a hollow-ingot and a calibrating roll train.

3. Process according to claim 1 characterized in that the wall thickenings of the ingots that protrude outward are pressed into the longitudinal hole after piercing rolling during subsequent passage through at least one roll stand on the entrance side of the push bench, before the actual pushing process is carried out in the subsequent stands.

4. Process according to claim 1, characterized in that the push bench has a clamping means and the wall thickenings of the ingots that protrude outward are pressed into the longitudinal hole by said clamping means, following piercing rolling, but in advance of the push bench stands.

5. Process according to one of claims 1 or 2 wherein the diagonal rolls of the piercing roll train are rapidly adjusted to a larger pass opening just prior to rolling the final end of each ingot whereby an outwardly projecting thickening of the pierced ingot is provided.

6. An apparatus for production of seamless tube comprising a piercing roll train having diagonal rolls and an axial stopper rod between said rolls for piercing and forming an ingot into a tubular shape having a pierced center hole, means for rapidly moving said diagonal rolls away from the stopper rod just prior to rolling the final end of each ingot whereby an outwardly projecting thickening of the pierced is provided, push bench means having a mandrel rod pushing the tubular shaped ingot through roll passes to form a seamless tube and means between the piercing roll train and push bench for pushing the unsupported outwardly projecting thickening of the pierced ingot into the pierced center hole at the end thereof to form a support member of generally uniform thickness against which the mandrel rod of the push bench engages and means for inserting the push bench mandrel into the pierced center hole to abut the previously formed support member.

7. Apparatus according to claim 6, characterized in that a hollow-ingot or calibrating roll train is located beyond the piercing roll train and in front of the push bench as the shaping mechanism for the wall thickenings.

* * * * *

UNITED STATES PATENT AND TRADEMARK OFFICE

CERTIFICATE OF CORRECTION

PATENT NO. : 4,577,481

DATED : March 25, 1986

INVENTOR(S) : KARLHANS STAAT

It is certified that error appears in the above-identified patent and that said Letters Patent is hereby corrected as shown below:

Column 6, line 51, Claim 3, after "1" insert --,--.

Column 7, line 8, Claim 6, after "pierced" insert --ingot--.

Signed and Sealed this

Twenty-second Day of December, 1987

*Attest:*

DONALD J. QUIGG

*Attesting Officer*

*Commissioner of Patents and Trademarks*